US010553962B2

(12) United States Patent
Farzaneh et al.

(10) Patent No.: US 10,553,962 B2
(45) Date of Patent: Feb. 4, 2020

(54) DIPOLE ANTENNA WITH BEAMFORMING RING

(71) Applicant: Communication Components Antenna Inc., Kanata (CA)

(72) Inventors: Sadegh Farzaneh, Kanata (CA); Minya Gavrilovic, Ottawa (CA); Jacob Van Beek, Stittsville (CA)

(73) Assignee: Communication Components Antenna Inc., Ontario (CA)

( * ) Notice: Subject to any disclaimer, the term of this patent is extended or adjusted under 35 U.S.C. 154(b) by 0 days.

(21) Appl. No.: 15/531,914

(22) PCT Filed: Aug. 31, 2015

(86) PCT No.: PCT/CA2015/050835
§ 371 (c)(1),
(2) Date: May 31, 2017

(87) PCT Pub. No.: WO2016/090463
PCT Pub. Date: Jun. 16, 2016

(65) Prior Publication Data

US 2017/0346191 A1 Nov. 30, 2017

Related U.S. Application Data

(60) Provisional application No. 62/089,608, filed on Dec. 9, 2014.

(51) Int. Cl.
*H01Q 21/26* (2006.01)
*H01Q 19/10* (2006.01)
(Continued)

(52) U.S. Cl.
CPC ..... *H01Q 21/26* (2013.01); *H01Q 19/10* (2013.01); *H01Q 19/108* (2013.01);
(Continued)

(58) Field of Classification Search
CPC ..... H01Q 19/108; H01Q 21/26
See application file for complete search history.

(56) References Cited

U.S. PATENT DOCUMENTS 3,778,838 A 12/1973 Clavin
8,164,536 B2 * 4/2012 Le ..... H01Q 19/10 343/793
(Continued)

FOREIGN PATENT DOCUMENTS

EP 1879256 A1 1/2008
WO 2005/122331 A1 12/2005

OTHER PUBLICATIONS

ISA/CA, International Search Report and Written Opinion for PCT Application No. PCT/CA2015/050835, dated Nov. 3, 2015.

*Primary Examiner* — Jessica Han
*Assistant Examiner* — Amal Patel
(74) *Attorney, Agent, or Firm* — Sofer & Haroun, LLP

(57) ABSTRACT

Systems, methods, and devices relating to antennas. A crossed dipole antenna element has a ring encircling the antenna. The ring, constructed of a conductive material, is not touching the arms of the dipole antenna and the distance between the ring and the arms of the antenna can be optimized. The antenna element assembly can be used in one or two dimensional antenna arrays.

7 Claims, 6 Drawing Sheets

(51) Int. Cl.
*H01Q 21/10* (2006.01)
*H01Q 21/20* (2006.01)
*H01Q 21/08* (2006.01)

(52) U.S. Cl.
CPC ..... *H01Q 21/08* (2013.01); *H01Q 21/10* (2013.01); *H01Q 21/205* (2013.01)

(56) References Cited

U.S. PATENT DOCUMENTS

2014/0043195 A1* 2/2014 Ho ..... H01Q 1/526
343/770
2016/0134026 A1* 5/2016 Tang ..... H01Q 15/14
343/797

* cited by examiner

DIPOLE ANTENNA WITH BEAMFORMING RING

TECHNICAL FIELD

The present invention relates to antennas. More specifically, the present invention relates to dipole antennas with a ring useful for beamforming and increasing gain.

BACKGROUND OF THE INVENTION

The telecommunications revolution of the late $20^{th}$ century has given rise to a plethora of new communications devices and methods. With this rise in communications capability comes a need for better means for disseminating radio based signals.

Previously, omnidirectional antennas were used for most radio based applications. Nowadays, more focussed antennas with a narrower beamwidth are use. These antennas can be placed in arrays to provide greater telecommunications coverage for densely packed areas such as sporting arenas, shopping malls, and the like.

To arrive at a narrower beamwidth, such as, for example, a 65 degree beamwidth, previous attempts have been made. However, none of these attempts have been satisfactory.

Previous attempts include using two elements in parallel in the azimuth plane with a proper feed network. Using this approach, the number of elements should be twice of a 65 degree element. Another approach involves staggering the elements to make two columns. Again, the number of elements required is higher than for an antenna with elements which have a beamwidth of 65 degrees. Another approach is that of controlling the height of the dipole antenna and the reflector size or side fences. However, none of these approaches can offer a stable beamwidth over 1710-2690 MHz. Another approach is that of using several parasitic elements in parallel to the reflector which increases the antenna depth.

In addition to the above issues, these approaches also have additional issues. Using two elements by staggering elements or in quad format increases the number of elements used. This increases the cost of the antenna. In addition, a beamwidth of 65 degrees is not guaranteed as beamwidth variation over 1710-2690 MHz is more than 5 degrees. If one reduces the height of the dipole antenna and uses a large reflector, this increases the size of the overall antenna. Again, this approach has a beamwidth variation of more than 5 degrees. If multiple resonators are used in parallel with a reflector, this increases the depth of the antenna.

Based on the above, this is therefore a need for systems, methods, and devices which avoid the shortcomings of the prior art.

SUMMARY OF INVENTION

The present invention provides systems, methods, and devices relating to antennas. A crossed dipole antenna element has a ring encircling the antenna. The ring, constructed of a conductive material, is not touching the arms of the dipole antenna and the distance between the ring and the arms of the antenna can be optimized. The antenna element assembly can be used in one or two dimensional antenna arrays.

In a first aspect, the present invention provides an antenna comprising:

a dipole antenna having two arms;

at least one beamforming structure encircling said dipole antenna, the or each of said at least one beamforming structure being spaced apart from said two arms;

wherein the or each of said at least one beamforming structure is constructed from a conductive material.

In a second aspect, the present invention provides an antenna array having at least two antenna elements, each antenna element comprising:

a crossed dipole antenna;

at least one beamforming structure encircling said crossed-dipole antenna;

wherein said at least one beamforming structure is constructed from a conductive material; and wherein said at least one beamforming structure is spaced apart from arms of said crossed dipole antenna.

BRIEF DESCRIPTION OF THE DRAWINGS

The embodiments of the present invention will now be described by reference to the following figures, in which identical reference numerals in different figures indicate identical elements and in which.

DETAILED DESCRIPTION

Figure 1:
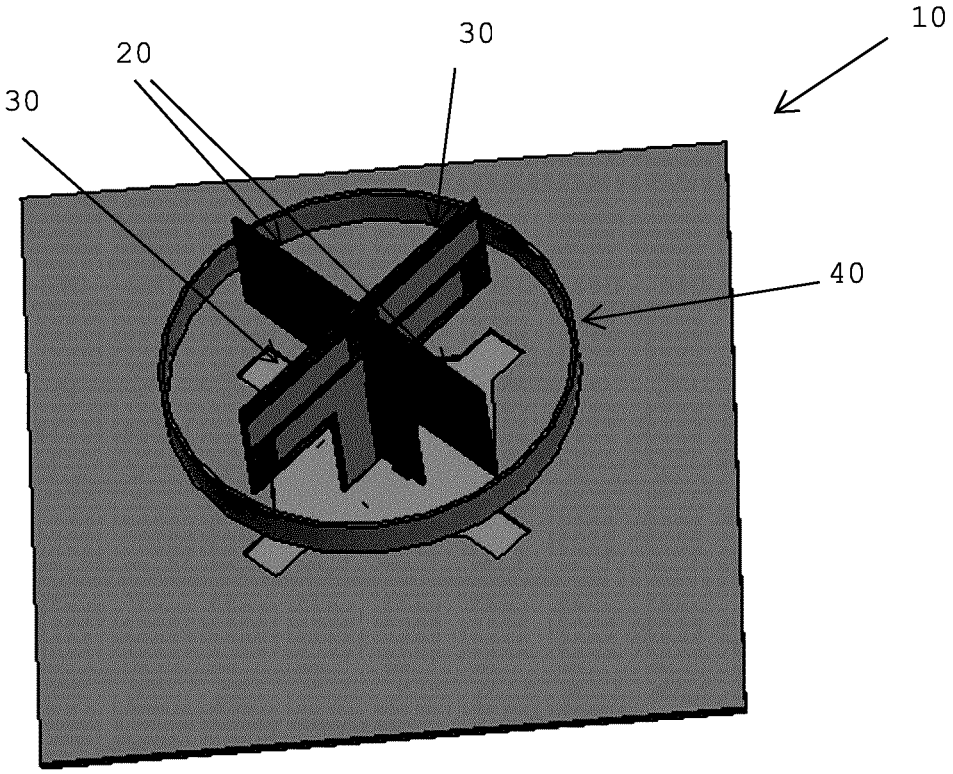
FIG. 1 is a diagram illustrating an antenna according to one aspect of the invention.

Referring to FIG. 1, an antenna 10 according to one aspect of the invention is illustrated. The antenna 10 has two dipole antennas 20, 30 which, together, form a crossed dipole antenna. A beamforming structure 40 encircles the crossed dipole antenna.

In FIG. 1, two dipole antennas 20, 30 are used. However, a single dipole antenna may also be used. As well, the beamforming structure 40 in FIG. 1 in the form of a ring. Other loop shapes, such as square loops, rectangular loops, cross loops, and other quadrilateral loops, may also be used. Depending on the beamforming shape, dipoles may be designed and tuned accordingly. The center of the beamforming structure is, preferably, collinear or coincident with the center axis of the dipole or crossed dipole antennas. As such, the center of the beamforming structure would be collinear with the axis where one dipole antenna meets another. For a crossed dipole antenna, the axis where all four single pole antennas meet is coincident with the center of the beamforming structure. Other variants of the beamforming structure will be explained below.

The use of the beamforming structure, especially in the form of a ring or an annulus, stabilizes the azimuth beam width, increases the antenna gain, and reduces grating lobe, cross-pole isolation, and beam squint. In addition, since rings do not have contact with a reflector, they do not generate passive intermodulation.

The beamforming structure is developed primarily for 1710-2690 MHz band. However, the concept has been applied to other frequency bands including but not limited to other cellular bands such as 1710-2360 MHz, 698-896 MHz, 698-960 MHz, and 596-960 Mhz. In either case using a ring with dipole configuration may increase the antenna gain, may stabilize the beamwidth, and may reduce grating lobe and cross-pol isolation.

With the use of a ring beamforming structure, it is possible to adjust the azimuth and elevation beamwidth without modifying the dipole antenna. This allows for the reconfiguration of the element pattern when the antenna is used in different antenna arrays. The beamforming structure can have its radius, height, or spacing from the dipole antenna adjusted depending on the desired operation band and dipole height.

The configuration illustrated in FIG. 1 is for an antenna with 65 degree azimuth beam width over 1710-2690 MHz. It may be modified to add additional rings with similar or different shapes. Addition of such rings modifies the impedance of the antenna as well. However, the dipole antenna can be re-tuned to work with either single or multiple rings. In practise, the crossed dipole antenna and the ring shaped beamforming structure is optimized for impedance matching by taking into account the ring in the system design.

The antenna in FIG. 1 is a dual polarization dipole antenna surrounded by a suspended ring and is for dual slant +/−45 degree polarization. Each dipole has a parasitic element with the same width but longer in length to offer 45% bandwidth which covers 1710-2690 MHz.

Figure 2:
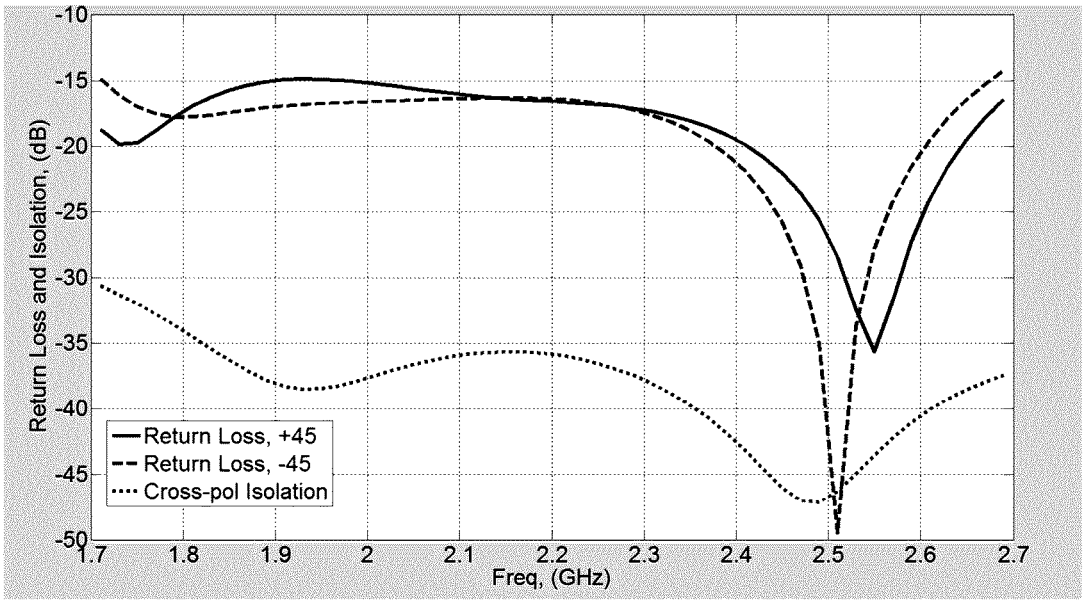
FIG. 2 is a plot showing the return loss and cross-pole isolation for the antenna illustrated in FIG. 1.

Referring to FIG. 2, the plot shows the return loss and cross-pole isolation for the antenna element. The plot shows that the antenna element has a better than 14 dB Return Loss and has a better than 30 dB cross-polarity isolation at 1710-2690 MHz.

Figure 3:
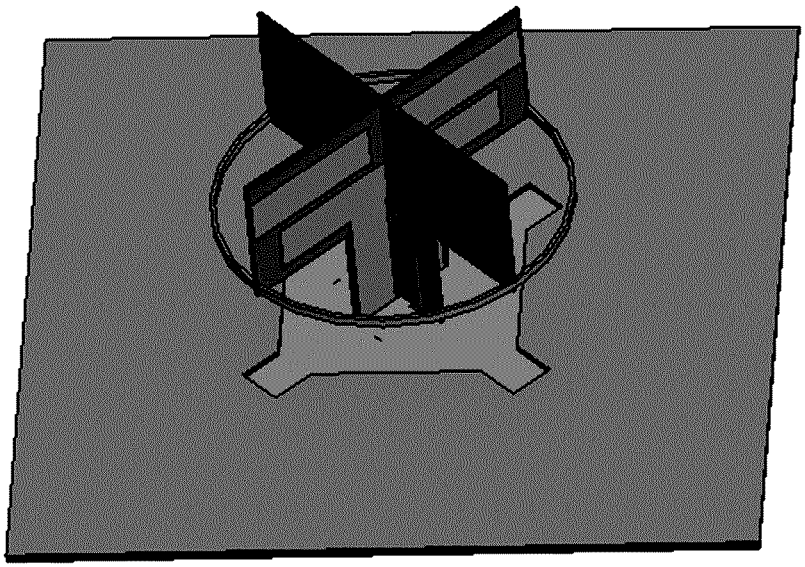
FIG. 3 is a diagram illustrating a variant of the antenna in FIG. 1.
Figure 4:
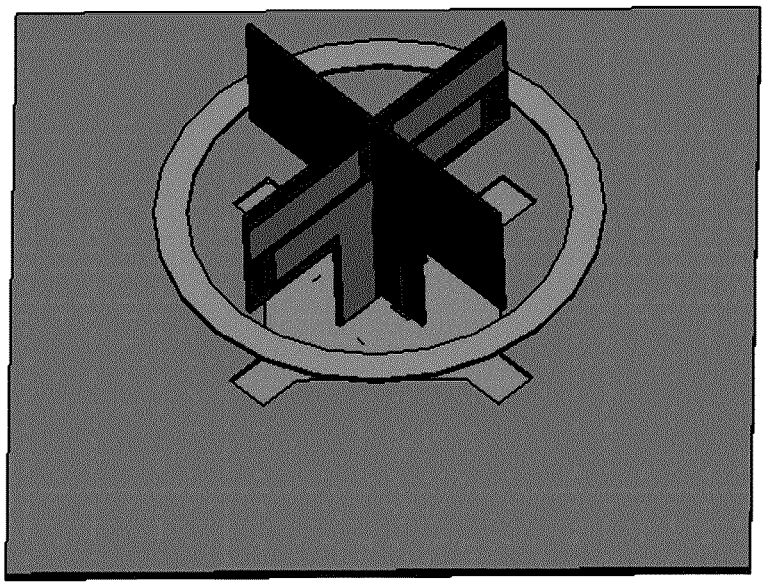
FIG. 4 is a diagram illustrating another variant of the antenna in FIG. 1.

Referring to FIGS. 3 and 4, variants of the present invention are illustrated. The embodiment illustrated in FIG. 1 has a beamforming structure that is tube-shaped. The shallow tube which encircles the dipole antenna is spaced apart from and is not in contact with the arms of the dipole antenna. In FIG. 3, the beamforming structure is a thin circle while in FIG. 4, the beamforming structure is annular in shape. Other shapes, as noted above, are also possible.

The beamforming structure may be placed below the arms of the dipole antenna as in FIGS. 3 and 4. Similarly, the beamforming structure may be located at the edge of the arms of the dipole antenna as in FIG. 1. The beamforming structure may be raised above the ground plane by suitable non-conductive supports. Alternatively, the beamforming structure may be suspended above the ground plane by suitable clips which attach the beamforming structure to the circuit boards on which the traces define the dipole antenna.

Regarding the design parameters for the beamforming structure, if a circular or annular shape is used, the diameter of the beamforming structure is preferably less than one wavelength based on the highest operating frequency. In one implementation, the height of the rings is around 10 mm for best performance. However, the height can be varied from 1-2 mm to 20 mm. In this implementation, the spacing between the reflector and ring shaped beamforming structure is close to the dipole height. Preferably, there is no metallic contact between the beamforming structure and the reflector base plate. This lack of contact between the base plate and the beamforming structure is good for passive inter-modulation.

Spacing between the beamforming structure and the reflector can be less than the dipole height and this determines the operating band of the antenna. The diameter of the ring-shaped beamforming structure is preferably about the length of dipole but can be smaller depending on the structure's height, frequency band, and application. Smaller diameter structures can be used for planar arrays where antenna elements need to be compact. Depending on the application, multiple beamforming structures with similar or different radii may also be used.

Regarding signal feed to the dipole antenna, FIGS. 1, 3, and 4 show dipole antennas which are fed from below. However, the dipole antenna can also be configured to be fed from above.

It should be noted that the data presented in this document for different sized beamforming structures is based on a fixed dipole antenna height. By modifying the dipole height and adding more beamforming structures, azimuth beamwidth can be modified.

The use of the ring shaped beamforming structure provides a number of advantages. Specifically, a 65 degree antenna azimuth pattern can be achieved over 1710-2690 MHz by adjusting the beamforming structure height. Another feature of the ring shaped beamforming structure is that azimuth and elevation beamwidth can be controlled by modifying the structure height for a fixed dipole. Using this feature allows one to design antennas with a reconfigurable pattern. As well, other antenna parameters such as antenna gain (by as much as 1 dB), cross-polarity isolation, cross-polarity discrimination, grating lobe, and beam squint are improved when a suitably designed beamforming structure is used. As another advantage, the deployment of a ring-shaped beamforming structure reduces the dipole size by around 10%.

Regarding construction, the beamforming structure may be constructed from any suitable conductive material. The dipole antenna may be constructed using conventional and well-known construction methods and materials.

Figure 6:
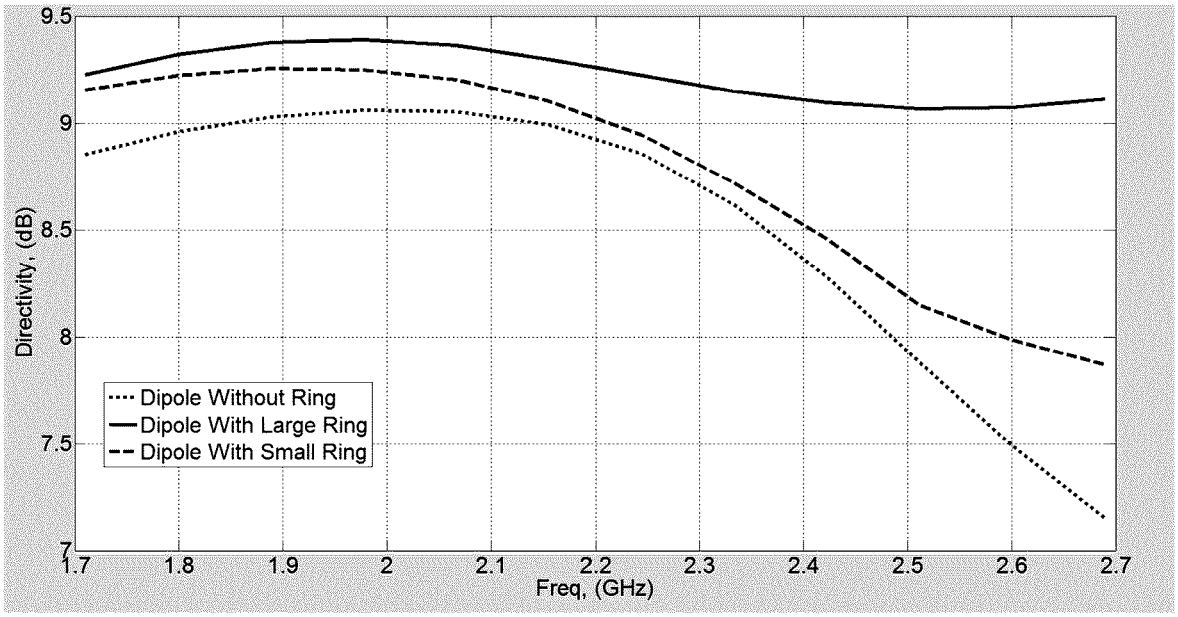
FIG. 6 is a plot which compares antenna directivity for a dipole antenna without a beamforming structure and for antennas which use different variants of the beamforming structure.

Referring to FIG. 6, a plot is provided that compares the antenna directivity for a dipole antenna without a ring-shaped beamforming structure, a dipole antenna with a large ring-shaped beamforming structure, and a dipole antenna with a small ring-shaped beamforming structure. As can be seen, antenna directivity at 2.7 GHz is increased by 2 dB by adding the large beamforming structure and is increased by 0.7 dB when a small beamforming structure is used.

Figure 7:
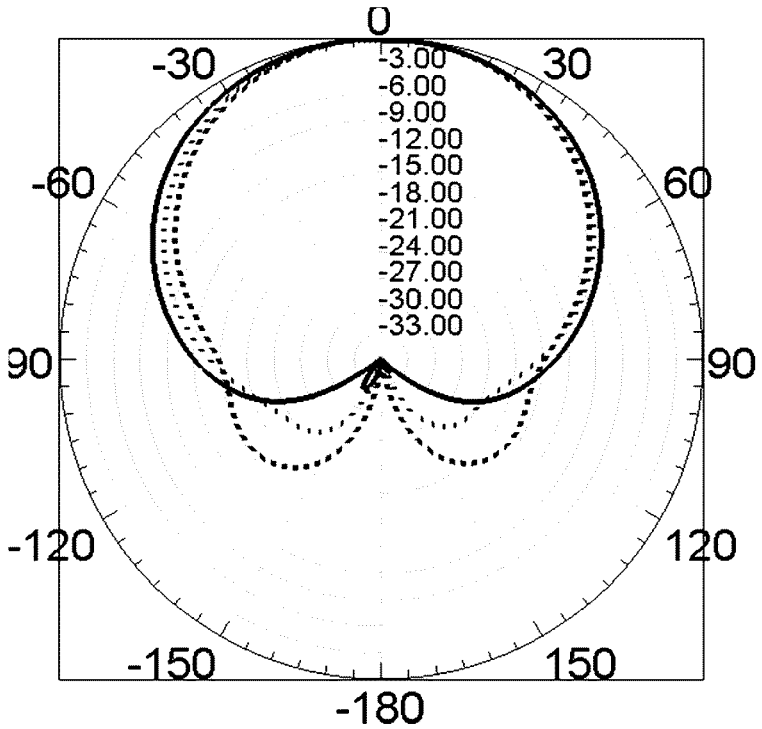
FIG. 7 illustrates the azimuth pattern for a dipole antenna not equipped with a beamforming structure for different frequencies.
Figure 8:
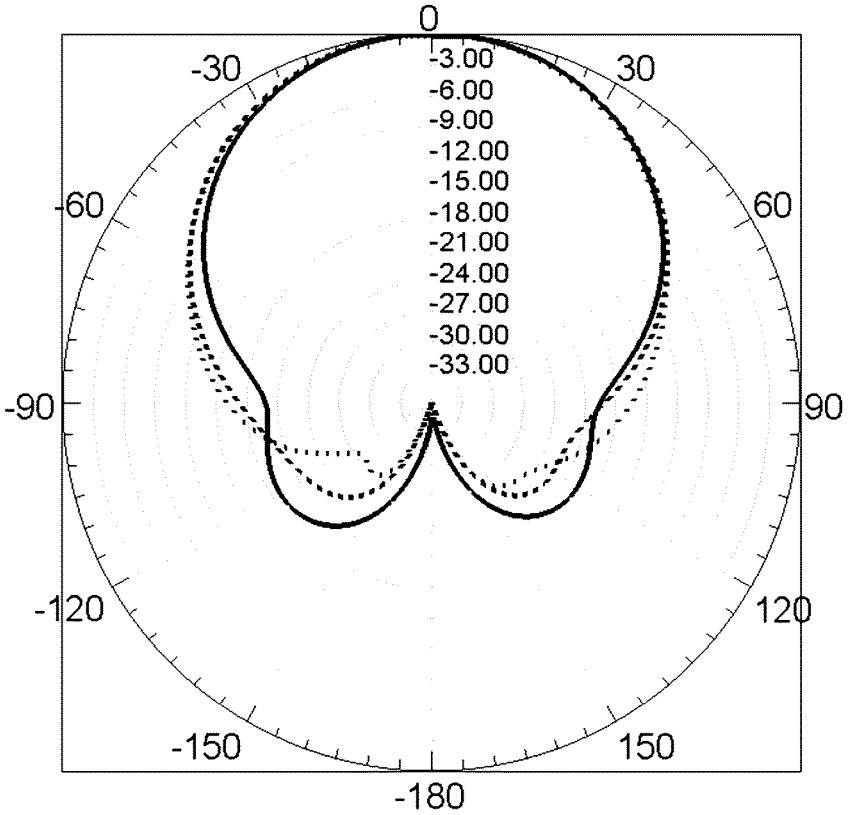
FIG. 8 illustrates the azimuth pattern for a dipole antenna equipped with a beamforming structures for frequencies similar to those used for FIG. 7.

Referring to FIG. 7, the figure shows the azimuth pattern for a dipole antenna not equipped with a beamforming structure on a 155 mm square reflector for 1.71 GHz, 2.2 GHz and 2.69 GHz. It can be seen that azimuth beamwidth varies from 67 degree at 1.71 GHz to 81 degree at 2.69 GHz. FIG. 8 shows the azimuth pattern for a dipole antenna which uses a large ring-shaped beamforming structure for 1.71 GHz, 2.2 GHz and 2.69 GHz. It can be seen from FIG. 8 that azimuth beamwidth is 65 degree for the three frequencies when a beamforming structure is used. When a dipole antenna is used, azimuth beamwidth variation is within +/−3 degree variation.

Figure 5:
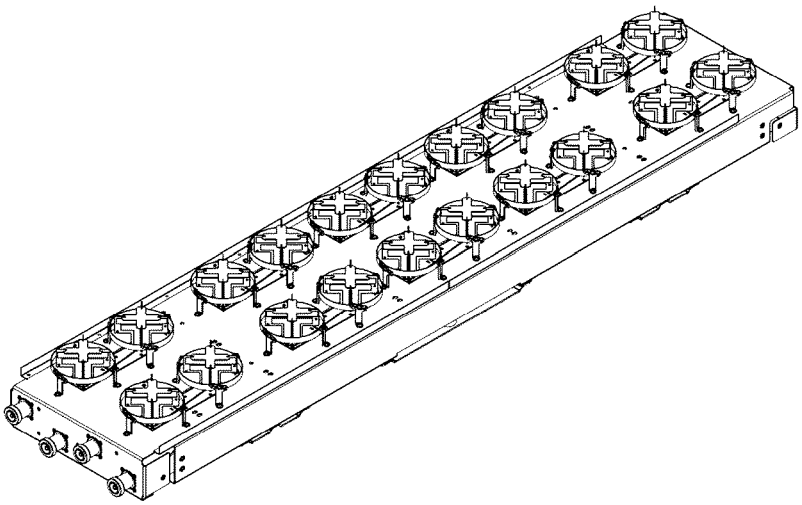
FIG. 5 is a two-dimensional array of antenna elements using a variant of the antenna in FIG. 1.
Figure 9:
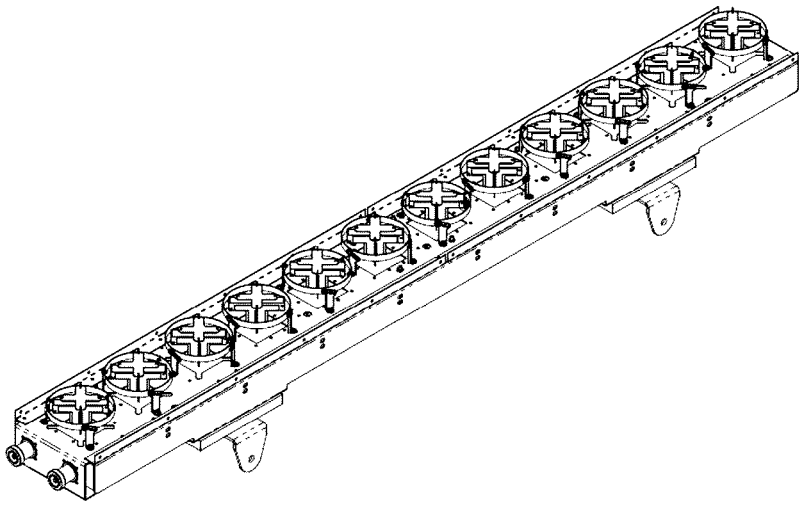
FIG. 9 shows a one dimensional array of antenna elements using a variant of the antenna in FIG. 1.
Figure 10:
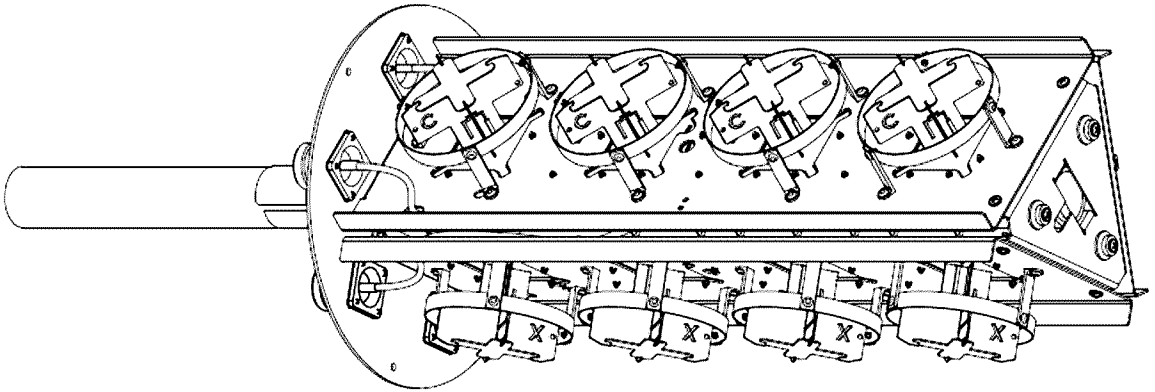
FIG. 10 shows a three-sector antenna using antenna elements which are a variant of the antenna in FIG. 1.

As noted above, antennas using the beamforming structure may be used in arrays. FIG. 9 illustrates a 2-port, one-dimensional array using a suitably designed crossed dipole antenna elements which use a beamforming structure. FIG. 5 shows a 4-port, two dimensional array with crossed dipole antenna elements with beamforming structures. Both antenna arrays in FIGS. 5 and 9 use the beamforming structure to obtain 65 degree azimuth beamwidth that has a frequency range of 1710-2690 MHz. Finally, FIG. 10 illustrates a six port tri-sector antenna in which each sector is covered with a panel with 65 degree azimuth beamwidth. The antenna elements used in the antenna of FIG. 10 also used crossed dipole antennas with a beamforming structure. Other configurations for antenna arrays are, of course, possible.

A person understanding this invention may now conceive of alternative structures and embodiments or variations of the above all of which are intended to fall within the scope of the invention as defined in the claims that follow.

We claim:

1. An antenna comprising:

a dipole antenna having two arms;

at least one beamforming structure in the shape of a closed ring encircling said dipole antenna, said at least one beamforming structure being spaced apart from said two arms;

wherein said at least one closed ring beamforming structure is constructed from a conductive material;

wherein a ground plane supports said at least one closed ring beamforming structure with no metallic contact therebetween;

wherein said closed ring beamforming structure is disposed at a height, from said ground plane, and relative to a height of said two arms of said dipole antenna to generate a 65°+/−3° degree azimuth beamwidth in a frequency range of 1710-2690 MHz.

2. An antenna according to claim 1, further comprising a second dipole antenna, said dipole antenna and said second dipole antenna forming a crossed dipole antenna, said at least one closed ring beamforming structure encircling both said dipole antenna and said second dipole antenna.

3. An antenna according to claim 2, wherein said crossed dipole antenna is an element in an array of antenna elements.

4. An antenna according to claim 1, wherein said at least one closed ring beamforming structure is annular in shape.

5. An antenna according to claim 4, wherein said height of two arms of said dipole antenna is the same as the height of said a at least one closed ring beamforming structure.

6. An antenna according to claim 1, wherein said at least one closed ring beamforming structure is a shallow tube in shape.

7. An antenna according to claim 1, wherein said antenna is one element in an array of antenna elements.

* * * * *